US012650062B2

(12) United States Patent
Kharrat et al.

(10) Patent No.: US 12,650,062 B2
(45) Date of Patent: Jun. 9, 2026

(54) DUAL SLEEVE VALVE SYSTEM

(71) Applicant: Schlumberger Technology Corporation, Sugar Land, TX (US)

(72) Inventors: Houssem Kharrat, Rosharon, TX (US); Mitchell Gamble, Calgary (CA); Austin Chen, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 92 days.

(21) Appl. No.: 18/834,751

(22) PCT Filed: May 26, 2023

(86) PCT No.: PCT/US2023/023689
§ 371 (c)(1),
(2) Date: Jul. 31, 2024

(87) PCT Pub. No.: WO2023/230326
PCT Pub. Date: Nov. 30, 2023

(65) Prior Publication Data

US 2025/0163776 A1 May 22, 2025

Related U.S. Application Data

(60) Provisional application No. 63/365,384, filed on May 26, 2022.

(51) Int. Cl.

| | |
|---|---|
| ***E21B 43/08*** | (2006.01) |
| ***E21B 34/06*** | (2006.01) |
| ***E21B 34/10*** | (2006.01) |
| ***E21B 34/14*** | (2006.01) |
| ***E21B 43/26*** | (2006.01) |

(52) U.S. Cl.
CPC ..... *E21B 43/08* (2013.01); *E21B 34/063* (2013.01); *E21B 34/102* (2013.01); *E21B 34/142* (2020.05); *E21B 43/26* (2013.01); *E21B 2200/06* (2020.05)

(58) Field of Classification Search
CPC ..... E21B 43/08; E21B 43/26; E21B 34/063; E21B 34/102; E21B 34/142; E21B 34/06; E21B 34/14; E21B 2200/06
See application file for complete search history.

(56) References Cited

U.S. PATENT DOCUMENTS 12,129,738 B2 10/2024 Kharrat
2012/0186803 A1* 7/2012 Xu ..... E21B 43/08 166/205

(Continued)

*Primary Examiner* — George S Gray
(74) *Attorney, Agent, or Firm* — Kyle R. Miiller

(57) ABSTRACT

A system and method for producing hydrocarbons from a well with a dual sleeve valve assembly. The dual sleeve valve assembly has a toe valve assembly and a production assembly. The toe valve assembly has a valve sleeve positioned in a valve housing comprising at least one fracturing port. The valve sleeve is shiftable to allow fluid through the least one fracturing port. The production assembly comprises a production sleeve positioned within a production outer housing comprising at least one screen port and at least one production port. A sand screen assembly disposed around the production outer housing. The production sleeve shiftable by a ball to allow fluid through the at least one screen port and the at least one production port.

20 Claims, 4 Drawing Sheets

(56) References Cited

U.S. PATENT DOCUMENTS

| | | | | |
|---|---|---|---|---|
| 2013/0025872 | A1* | 1/2013 | Mailand | E21B 34/10 166/332.1 |
| 2013/0048298 | A1* | 2/2013 | Merron | E21B 34/14 166/373 |
| 2013/0233561 | A1* | 9/2013 | Xu | E21B 34/142 166/308.1 |
| 2014/0048263 | A1 | 2/2014 | Acosta | |
| 2014/0251619 | A1 | 9/2014 | George | |
| 2014/0262251 | A1 | 9/2014 | O'Malley et al. | |
| 2017/0067314 | A1* | 3/2017 | Flores Perez | E21B 34/142 |
| 2018/0347330 | A1* | 12/2018 | Facca | E21B 43/08 |
| 2019/0100980 | A1* | 4/2019 | Fuxa | E21B 34/142 |
| 2020/0362668 | A1 | 11/2020 | Fripp | |
| 2021/0348474 | A1* | 11/2021 | Johnson | E21B 34/06 |

* cited by examiner

DUAL SLEEVE VALVE SYSTEM

CROSS-REFERENCE TO RELATED APPLICATION

The present document is a national stage entry of PCT Application No. PCT/US2023/023689, filed May 26, 2023, which is based on and claims priority to U.S. Provisional Application Ser. No. 63/365,384, filed May 26, 2022, which is incorporated herein by reference in its entirety.

BACKGROUND

In a variety of well applications, a toe valve may be positioned along a casing string to enable selective communication between a wellbore and the surrounding reservoir via circumferential flow ports. In a multistage stimulation, for example, a toe valve may be run at the toe of the casing in a closed position. The toe valve is then actuated to open the circumferential flow ports to provide communication between the interior of the casing and the surrounding reservoir. This allows an operator to run perforation guns, plugs, and other tools via wireline in a horizontal section of the wellbore by pumping fluids down through the casing string. The pumped fluids effectively push the tool or tools along the wellbore before exiting the casing through the flow ports of the toe valve. In some subsequent operations, such as sand control, there is a need to sequentially close one set of ports and open a second set of ports covered by a sand screen assembly.

SUMMARY

In general, a system and methodology providing improved control of fluid flow between an interior and an exterior of a tubing string. The improved control of fluid is accomplished with a dual sleeve valve system. For purposes of explanation, the dual sleeve valve system is described in the form of a dual sleeve valve system positioned along the tubing string.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe embodiments of the disclosure.

The disclosure herein generally involves a system and methodology providing improved control of fluid flow between an interior and an exterior of a tubing string, e.g. improved communication between a wellbore and a surrounding reservoir. According to an embodiment, a dual sleeve valve system may be positioned along a casing string or other type of tubing string. For purposes of explanation, the dual sleeve valve system is described in the form of a dual sleeve valve system positioned along the tubing string. However, the dual sleeve valve system may have other configurations and may be used in other types of operations or at other locations along a tubing string.

As described in greater detail below, a pressure increase along the interior of the tubing string may be used to initially open one or more fracturing ports of the dual sleeve valve system, thus allowing radial flow between an interior and an exterior of the tubing string. After the initial activation, a drop ball, plug, or similar means may be used to close the fracturing ports and open one or more production ports covered by a sand screen assembly.

Figure 1:
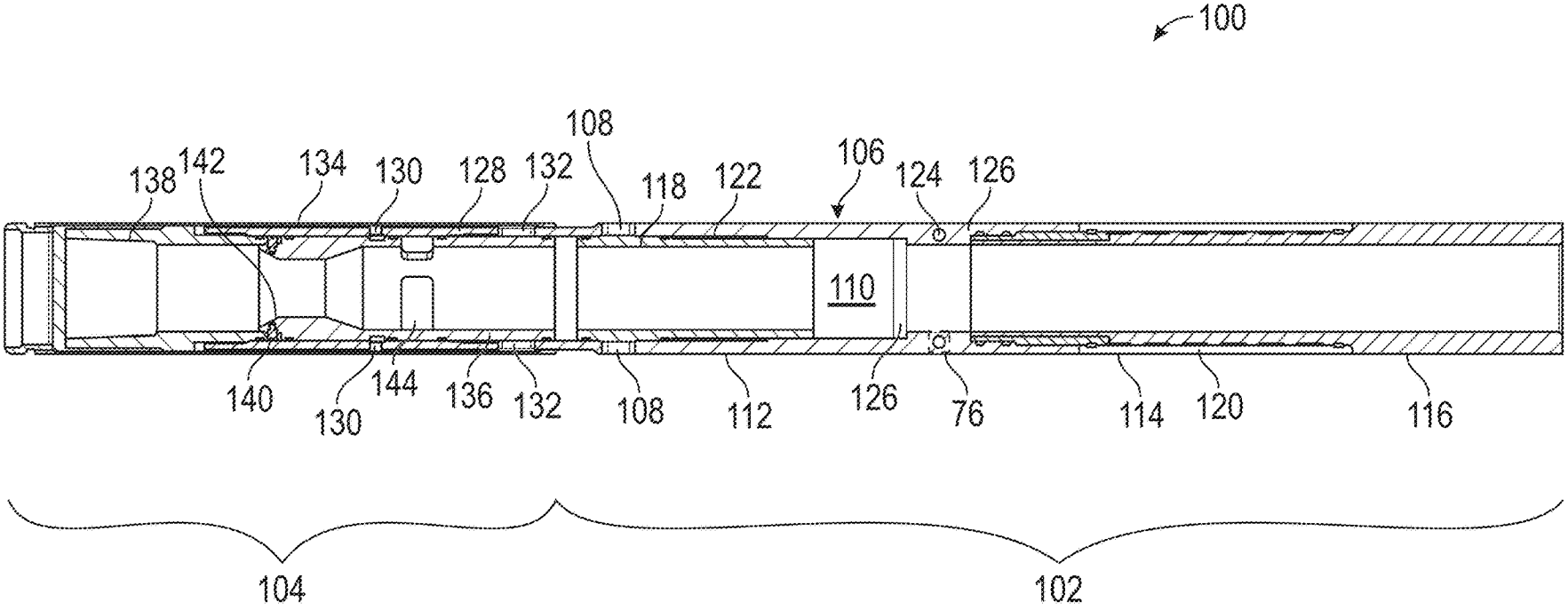
FIG. 1 is a cross-sectional diagram of a dual sleeve valve system in a first position according to an embodiment of the disclosure.

FIG. 1 is a cross-sectional diagram of a dual sleeve valve system 100 in a first position or run-in position according to an embodiment of the disclosure. In this embodiment, the dual sleeve valve system 100 is described as having a toe valve assembly 102 and a production assembly 104 disposable along a tubing string. However, the dual sleeve valve system 100 may have other dual sleeve valve system configurations for use in other types of operations, tubing strings, and/or locations along the tubing string. For example, the tubing string may be in the form of a casing string, which may be positioned within a borehole, e.g. a wellbore.

A borehole is drilled into a surrounding reservoir, and the dual sleeve valve system 100 controls fluid communication between the tubing string and the surrounding reservoir. In other words, the dual sleeve valve system 100 may be operated to control fluid flow between a bore and an exterior of the tubing string when the tubing string is positioned within a borehole. Depending on the parameters of specific operations, the size, components, and materials used in the construction of tubing string, as well as dual sleeve valve system 100, may be changed or adjusted.

In the illustrated embodiment, the toe valve assembly 102 comprises an outer housing 106 having at least one fracturing port 108 to enable fluid flow between a bore 110 and an exterior of the dual sleeve valve system 100. In some embodiments, the outer housing 106 may comprise a plurality of outer housings, such as an upper housing 112 coupled with an intermediate housing 114 and a lower housing 116. The lower housing 116 may be used to connect the dual sleeve valve system 100 into the overall tubing string. Additionally, the at least one port 108 may comprise a plurality of fracturing ports 108 which allow fluid flow between the bore 110 and the exterior of the dual sleeve valve system 100 and thus between the bore and exterior of the overall tubing string. In some embodiments, the plurality of ports 108 may be oriented in a generally radial direction through the outer housing 106 and may be arranged along a circumference of the outer housing 106.

The toe valve assembly 102 further comprises a toe valve sleeve 118 slidably mounted within the outer housing 106 for movement between a closed position, shown in FIG. 1, and an open position shown in FIG. 2 and described in more detail below. The toe valve sleeve 118 may comprise a plurality of seals located about its circumference and oriented to form a sealing engagement with an interior surface of the outer housing 106. In the closed position, the toe valve sleeve 118 is located so as to cover the fracturing ports 108 with the seals located on both sides of ports 108, thus preventing flow into the bore 110 through the fracturing ports 108.

The toe valve sleeve 118 may initially be held in the closed position via a chamber system having, for example, an atmospheric chamber 120 connected with a sleeve chamber 122 via at least one passageway 124 initially blocked by a release member 126, e.g. a rupture disc. As shown in FIG. 1, the sleeve chamber 122 may be located between the toe valve sleeve 118 and the outer housing 106. For example, the sleeve chamber 122 may be an annular chamber disposed about the toe valve sleeve 118. Initially, sleeve chamber 122 is filled with a liquid, such as a suitable oil or other appropriate liquid, which is held in sleeve chamber 122 via a release member 126. Increased or decreased pressure within the bore 110 of the dual sleeve valve system 100 acts on the toe valve sleeve 118 and causes a corresponding increase or decrease in the pressure of the liquid within the sleeve chamber 122. As a result, a continual pressure balance is maintained between an interior and an exterior of the toe valve sleeve 118 while liquid remains in the sleeve chamber 122.

Once sufficient pressure is applied within the bore 110 of the dual sleeve valve system and against the toe valve sleeve 118, the resulting increased pressure of liquid opens the release member 126. For example, if release member 126 is a rupture disc, the interior pressure may be increased to a level sufficient to rupture the rupture disc. Following rupture or other type of release, the liquid is able to flow out of the sleeve chamber 122, through the passageway 124, and into atmospheric chamber 120. A flow restrictor 76 is positioned along passageway 124 to restrict the flow, i.e. the flow rate, of liquid as it moves along the passageway 124 following rupture of rupture disc. Once passageway 124 is open to flow, the liquid is able to flow at a controlled rate through flow restrictor 76, through the open release member 126, and ultimately into atmospheric chamber 120. In some embodiments, other components may be positioned along passageway 124.

Figure 2:
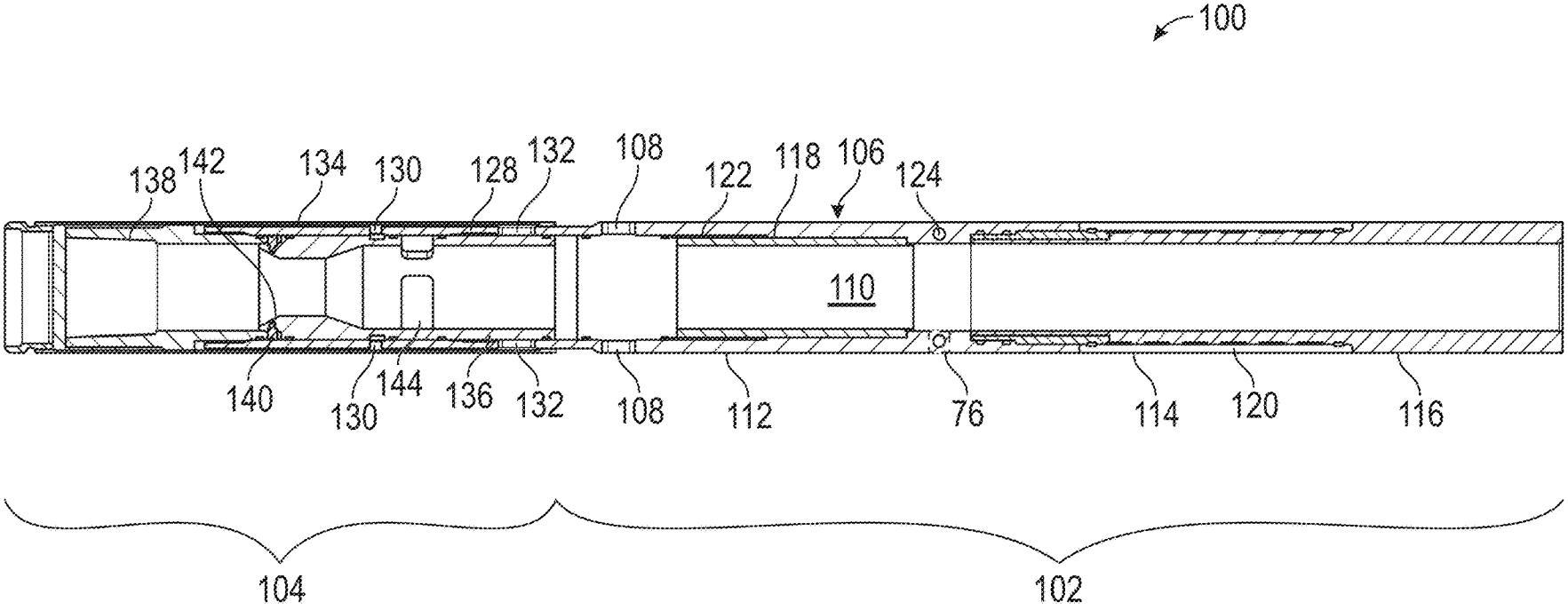
FIG. 2 is a cross-sectional diagram of a portion of the dual sleeve valve of FIG. 1 in a second position.

The toe valve sleeve 118 continues to move under pressure until it has shifted to an open position in which the fracturing ports 108 are open to flow, as illustrated in FIG. 2. Shifting of the toe valve sleeve 118 may ultimately be limited via an abutment or other suitable stop. It should be noted the atmospheric chamber 120 may initially be an empty chamber containing air or other suitable gas which is compressed or displaced as liquid is forced into the atmospheric chamber 120. Depending on the parameters of a given application, the atmospheric chamber 120 may be constructed as an annular chamber and may be located between the intermediate housing 114 and the lower housing 116, as shown in FIG. 1.

The production assembly 104 includes an outer housing 128 having one or more production ports 130 and one or more screen ports 132 to enable fluid flow between a bore 110 and an exterior of the dual sleeve valve system 100. A sand screen assembly 134 surrounds the outer housing 128 and covers the production ports 130 and the screen ports 132. The sand screen assembly 134 may be a wire wrap or similar assembly capable of reducing an amount of particulates that enter the bore 110 with the reservoir fluid.

The production assembly 104 further includes a production sleeve 136 coupled to a retention assembly 138 via a shear assembly 140, e.g., shear screws, shear ring or similar shearable retainers. In other embodiments, the retention assembly 138 may be omitted and the production sleeve 136 may be coupled to the outer housing 128 via the shear assembly 140. The production sleeve 136 includes a seat 142 for a ball or plug, as described in more detail below, and one or more compensation ports 144 sized and positioned to prevent hydraulic lock as the production sleeve 136 is shifted from the closed position shown in FIG. 1 to an open position, shown in FIG. 4.

Turning now to FIG. 2, FIG. 2 is a cross-sectional diagram of a portion of the dual sleeve valve system 100 of FIG. 1 in a second position or a fracturing position. As discussed above, pressure is applied to the bore 110 of the dual sleeve valve system 100 to shift the toe valve sleeve 118 to the open position. Fracturing operations or other operations requiring an opening at the toe of the production string can then be conducted utilizing the fracturing ports 108. Once these operations are completed, the dual sleeve valve system 100 can be shifted again to close the fracturing ports and open the screen ports 132 and the production ports 130 to allow for production of reservoir fluids proximate the dual sleeve valve system 100.

Figure 3:
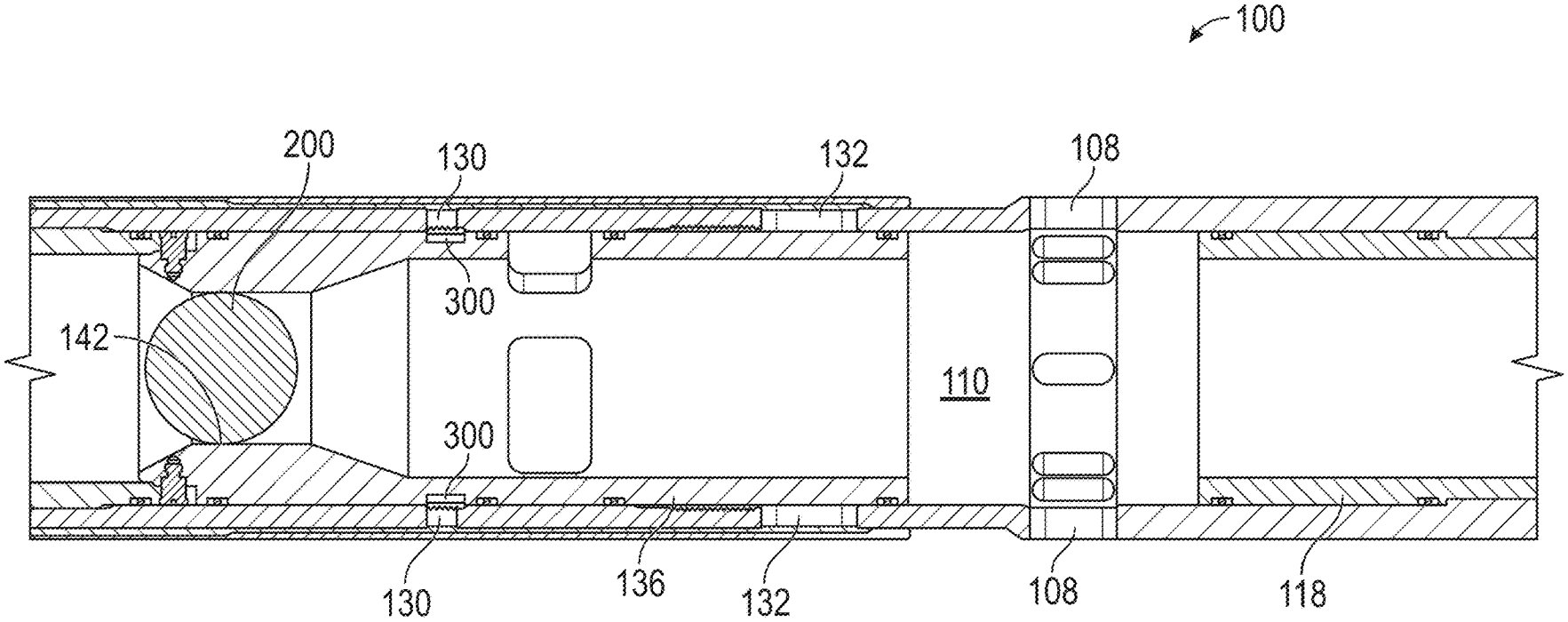
FIG. 3 is a cross-sectional diagram of the hydraulic section of the dual sleeve valve of FIG. 1 in a second position with a ball in a seat.

As shown in FIG. 3, a ball 200 is dropped down the production string and into the bore 110 of the dual sleeve valve system 100, where it contacts and seals against the seat 142 of the production sleeve 136. In other embodiments, a plug or similar sealing mechanism may be used in place of a ball 200. Once the ball 200 is seated, the pressure on the ball 200 can be increased to shift the production sleeve 136.

Figure 4:
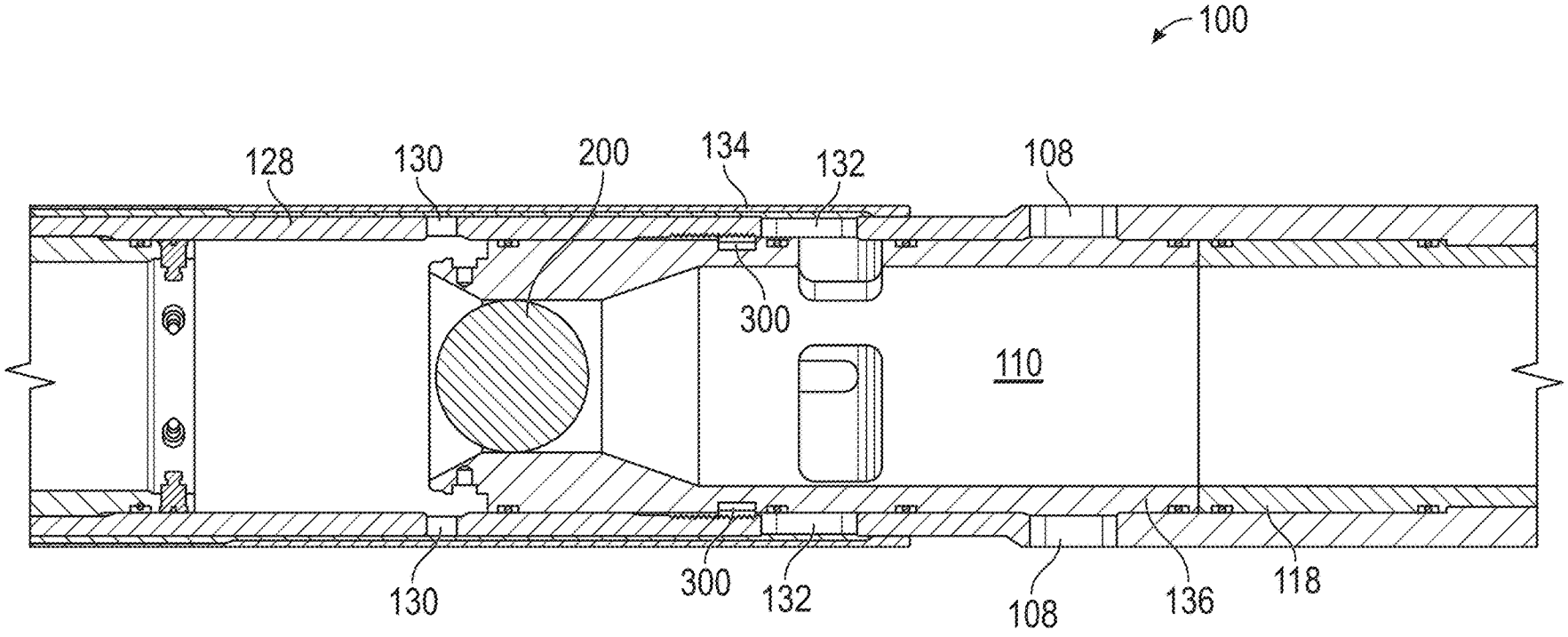
FIG. 4 is a cross-sectional diagram of the hydraulic section of the dual sleeve valve of FIG. 1 in a third position.

Turning now to FIG. 4, FIG. 4 is a cross-sectional diagram of the hydraulic section of the dual sleeve valve of FIG. 1 in a third position or production position. Once sufficient pressure has been applied to the ball 200, the shear assembly 140 retaining the production sleeve 136 in position shears and the production sleeve 136 shifts towards the toe valve sleeve 118. The shifting of the production sleeve 136 closes the fracturing ports 108 and opens the production ports 130.

As the production sleeve 136 shifts towards the toe valve sleeve 118 and closes the fracturing ports 108, the compensation ports 144 in the production sleeve 136 at least partially align with the screen ports 132 formed in the outer housing 128. This allows fluid within the bore 110 of the toe valve assembly 102 to flow out of the dual sleeve valve assembly 100, preventing hydraulic lock that would otherwise prevent the production sleeve 136 from fully shifting to the position shown in FIG. 4. As the production sleeve 136 shifts, a ratchet mechanism 300 is used to prevent the production sleeve 136 from shifting back to the closed position. Once the production sleeve 136 is fully shifted to the production position, reservoir fluids pass through the sand screen assembly 134 and travel uphole through the production string. Furthermore, the ball can be dissolved or retrieved at the surface due to reservoir fluid pressure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A dual sleeve valve system comprising:

a valve assembly comprising:

a valve outer housing comprising at least one fracturing port; and a valve sleeve positioned within the valve outer housing to prevent fluid flow through the at least one fracturing port, the valve sleeve operable to shift to an open position and allow the fluid flow through the at least one fracturing port when pressure is applied to a bore of the dual sleeve valve system; and a production assembly comprising:

a production outer housing comprising a screen port and a production port, the production outer housing extending along a tubing string, the screen port and the production port spaced apart from one another in a longitudinal direction with respect to the tubing string;

a sand screen assembly disposed around the production outer housing; and a production sleeve comprising a seat and at least one compensation port positioned between the screen port and the production port, the production sleeve positioned within the production outer housing to prevent the fluid flow through the screen port and the production port and operable to shift to the open position to allow the fluid flow through the screen port and the production port and prevent the fluid flow through the at least one fracturing port.

2. The dual sleeve valve system of claim 1, wherein the valve assembly further comprises an atmospheric chamber connected with a sleeve chamber via at least one passageway initially blocked by a release member, the valve sleeve slidably mounted within the valve outer housing for movement between a closed position and an open position.

3. The dual sleeve valve system of claim 2, wherein the sleeve chamber is filled with a fluid and the fluid is held in the sleeve chamber by the release member.

4. The dual sleeve valve system of claim 3, wherein the atmospheric chamber is a chamber containing air or other gas; wherein the air or the other gas is compressed or displaced as the fluid is forced into the atmospheric chamber.

5. The dual sleeve valve system of claim 2, wherein the release member is a rupture disc.

6. The dual sleeve valve system of claim 2, further comprising a flow restrictor positioned along the at least one passageway to restrict the fluid flow of fluid in the sleeve chamber as the fluid moves along the at least one passageway.

7. The dual sleeve valve system of claim 1, wherein the seat receives a ball.

8. The dual sleeve valve system of claim 1, further comprising a ratchet mechanism that prevents the production sleeve from reverse motion and shifting back to a closed position.

9. The dual sleeve valve system of claim 1, wherein the sand screen assembly covers the production port and the screen port.

10. A method for producing hydrocarbons from a well, the method comprising:

disposing a tubing string comprising a dual sleeve valve system within a wellbore;

shifting a valve sleeve of a valve assembly of the dual sleeve valve system to open at least one fracturing port in a valve outer housing of the valve assembly to allow fluid flow through the at least one fracturing port; and shifting a production sleeve of a production assembly of the dual sleeve valve system, the production sleeve extending along the tubing string, a screen port and a production port spaced apart from one another in a longitudinal direction with respect to the tubing string to close the at least one fracturing port to prevent fluid flow through the at least one fracturing port and open the screen port and the production port in a production outer housing to allow fluid flow through a sand screen assembly of the production assembly and the screen port and the production port.

11. The method of claim 10, wherein the valve sleeve is initially held in a closed position by a release member.

12. The method of claim 11, wherein the valve assembly comprises an atmospheric chamber connected with a sleeve chamber via at least one passageway, and wherein the at least one passageway is initially blocked by the release member.

13. The method of claim 12, wherein the sleeve chamber is filled with a fluid and the fluid is held in the sleeve chamber by the release member.

14. The method of claim 13, wherein, during the shifting of the valve sleeve, the atmospheric chamber is a chamber containing air or other gas, and wherein the air or the other gas is compressed or displaced as the fluid is forced into the atmospheric chamber from the sleeve chamber via the at least one passageway.

15. The method of claim 12, wherein the release member is a rupture disc.

16. The method of claim 12, wherein a flow restrictor is positioned along the at least one passageway to restrict a flow of fluid in the sleeve chamber as the fluid moves along the at least one passageway.

17. The method of claim 12, further comprising increasing a pressure in the interior of the tubing string to initially open the at least one fracturing port of the valve assembly by shifting the valve sleeve by opening the release member.

18. The method of claim 10, wherein the production sleeve has a seat for a ball that is dropped down the tubing string, and wherein once the ball is seated in the seat, a pressure on the ball can be increased to shift the production sleeve.

19. The method of claim 10, further comprising a ratchet mechanism preventing the production sleeve from reverse motion and from shifting back to a closed position after the shifting of the production sleeve.

20. The method of claim 10, wherein the shifting of the production sleeve positions the sand screen assembly around the production outer housing and covers the production port and the screen port.

* * * * *